US007910167B2

(12) United States Patent
Kasuga

(10) Patent No.: US 7,910,167 B2
(45) Date of Patent: Mar. 22, 2011

(54) METHOD OF FORMING A FILM ON A SUBSTRATE

(75) Inventor: Osamu Kasuga, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1101 days.

(21) Appl. No.: 11/251,843

(22) Filed: Oct. 18, 2005

(65) Prior Publication Data

US 2006/0115581 A1 Jun. 1, 2006

(30) Foreign Application Priority Data

Nov. 26, 2004 (JP) ..... 2004-341593

(51) Int. Cl.
*B05D 3/06* (2006.01)

(52) U.S. Cl. ..... 427/299; 427/8; 427/535

(58) Field of Classification Search ..... 427/532, 427/533, 535, 553, 569, 402, 8, 299
See application file for complete search history.

(56) References Cited

U.S. PATENT DOCUMENTS

| | | | |
|---|---|---|---|
| 6,599,582 | B2 | 7/2003 | Kiguchi et al. |
| 6,959,502 | B2 | 11/2005 | Nakamura et al. |

FOREIGN PATENT DOCUMENTS

| | | | | |
|---|---|---|---|---|
| JP | S64-59919 | A | | 3/1989 |
| JP | 09-090365 | A | * | 4/1997 |
| JP | 09-090365 | A | | 4/1997 |
| JP | 2001-184732 | A | | 7/2001 |
| JP | 2001-185464 | A | | 7/2001 |
| JP | 2004-219038 | A | | 8/2004 |
| JP | 2004-294879 | A | | 10/2004 |
| KR | 1999-67996 | A | | 8/1999 |
| KR | 2004-71191 | A | | 8/2004 |
| TW | 383280 | B | | 3/2000 |

OTHER PUBLICATIONS

Chu Guo-hong et al.; "Surface Modification of CPP Film by means of Plasma"; Journal of Jinan University, Dec. 2003, vol. 17. No. 4, School of Chemistry and Chemical Engineering, Jinan University, Jinan 250022, China.

* cited by examiner

*Primary Examiner* — William Phillip Fletcher, III
(74) *Attorney, Agent, or Firm* — Global IP Counselors, LLP

(57) ABSTRACT

A film-forming method of forming a film on a substrate includes performing a surface-improving treatment on the substrate, determining whether a predetermined amount of time has passed since the surface-improving treatment has been performed on the substrate, applying a film-forming solution to the substrate when it is determined that the predetermined amount of time has not passed, and repeating the surface-improving treatment on the substrate when it is determined that the predetermined amount of time has passed.

5 Claims, 4 Drawing Sheets

| Elapsed Time (min) | Contact Angle | Streaking |
|---|---|---|
| 0 | 2° | ○ |
| 15 | 3° | ○ |
| 30 | 5° | ○ |
| 45 | 8° | △ |
| 60 | 12° | × |

Allowable Film-Forming Treatment Time

Figure 3

METHOD OF FORMING A FILM ON A SUBSTRATE

BACKGROUND OF THE INVENTION

1. Field of the Invention

The present invention relates to a film-forming apparatus and a film-forming method which form a color filter, orientation film, or another such specific film with substantially a uniform thickness on a substrate.

2. Background Information

When a substrate is to be coated with a material (film-forming material) for forming a color filter or an orientation film or other film, the substrate surface is generally subjected to a certain treatment (surface-improving treatment such as lyophilic treatment) in order to improve the wet-spreading (wettability, lyophilicity) of the film-forming material on the surface of the substrate. Such treatment improves the wettability of the substrate and makes it possible, for example, for an orientation film for a liquid crystal display device to be stably formed with a uniform thickness on the substrate.

It is known that when the substrate surface is subjected to a specific treatment such as the one described above to improve the wettability of the substrate, the substrate has sufficient wettability immediately after the treatment is performed. However, the wettability deteriorates over time. If, for example, an accident occurs in the production line, it may take longer time than it would ordinarily for the substrate that has been subjected to the treatment to be conveyed to the apparatus where the film-forming material is applied.

When it takes longer time for the substrate to be conveyed than is ordinarily required, the substrate may be coated with a film-forming material without sufficient wettability on the surface of the substrate. In such cases, for example, display defects in the liquid crystal display device may result. However, there has been no control over the time it takes for the substrate that has been subjected to the treatment to reach the apparatus where the film-forming material is applied. Accordingly, it has been impossible to determine whether the substrate has sufficient wettability.

Inkjet droplet ejection apparatuses are often used to form an orientation film or another film to curtail the consumption of film-forming material and to reduce the number of manufacturing steps in the film-forming process. When a film is formed using an inkjet droplet ejection apparatus, the wettability of the substrate has a greater effect on the thickness of the resulting film than when the film is formed by dispensing or spin coating, for example. Specifically, if the substrate does not have sufficient wettability, it is difficult to form a uniform film.

In view of the above, it will be apparent to those skilled in the art from this disclosure that there exists a need for improved film forming apparatus and film forming method that overcome the problem of the conventional art. This invention addresses this need in the art as well as other needs, which will become apparent to those skilled in the art from this disclosure.

SUMMARY OF THE INVENTION

An object of the present invention is to provide a film-forming apparatus and a film-forming method which allow a film with a substantially uniform thickness to be formed on a substrate.

The present invention provides a film-forming apparatus for forming a film on a substrate, the apparatus having a surface-improving treatment device configured to perform a surface-improving treatment on the substrate, a film-forming solution applicator configured to apply a film-forming solution for forming the film to the substrate that has been subjected to the surface-improving treatment by the surface-improving treatment device, and a time controller configured to obtain a time period since the time the surface-improving treatment is conducted by the surface-improving treatment device on the substrate.

Also, in the film-forming apparatus according to another aspect of the present invention, the surface-improving treatment device configured to perform a lyophilic treatment to the substrate.

The present film-forming apparatus monitors the time since the surface-improving treatment of the substrate. Specifically, it is known that the wettability of a substrate subjected to surface-improving treatment, for example, lyophilic treatment, decreases over time, and therefore a substrate having appropriate wettability can be coated with a film-forming solution by controlling the period of time that elapses since the time when the substrate leaves the surface-improving treatment device. Therefore, a film having a uniform thickness can be formed by applying a film-forming solution to a substrate having an appropriate wettability.

Also, in the film-forming apparatus according to still another aspect of the present invention, the time controller stores an allowable film forming treatment time criterion, and the time controller is configured to prevent the film-forming solution from being applied to the substrate if the measured time period of the substrate does not satisfy the allowable film forming treatment time criterion.

With this film-forming apparatus, a substrate for which the predetermined amount of time (allowable film forming treatment time) has passed after the surface-improving treatment can be prevented from being subjected to application of the film-forming solution. Specifically, it is possible to prevent the film-forming solution from being applied to a substrate for which the predetermined amount of time has passed after the surface-improving treatment and whose wettability has decreased. Therefore, the film-forming solution can be applied solely to a substrate having sufficient wettability, and a film with a uniform thickness can be formed with high precision.

Also, in the film-forming apparatus according to still another aspect of the present invention, the allowable film forming treatment time criterion includes a condition of not being longer than a predetermined period of time, and the time controller is configured to prevent the film-forming solution from being applied to the substrate if the obtained time period of the substrate exceeds the period of time indicated by the allowable film forming treatment time criterion.

Also, the film-forming apparatus according to still another aspect of the present invention further includes a first conveyor configured to convey the substrate from the surface-improving treatment device to the film-forming solution applicator via the time controller; and a second conveyor configured to convey the substrate from the time controller to the surface-improving treatment device, the second conveyor being configured to be driven to convey the substrate thereon if the obtained time period of the substrate does not satisfy the allowable film forming treatment time criterion.

Also, in the film-forming apparatus according to the sixth aspect of the present invention, the allowable film forming treatment time criterion is determined based on likeliness of occurrence of streaking with the surface-improving treatment performed by the surface-improving treatment device.

Also, in the film-forming apparatus according to still another aspect of the present invention, the film-forming solution applicator is an inkjet droplet ejection apparatus that is configured to eject the film-forming solution onto the substrate.

With this film-forming apparatus, a film-forming solution is applied to a substrate by an inkjet droplet ejection apparatus. Specifically, since the film-forming solution is applied only to a substrate having sufficient wettability, a film with a substantially uniform thickness can be formed with high precision when the substrate is coated with a film-forming solution using an inkjet droplet ejection apparatus. Therefore, the use of an inkjet droplet ejection apparatus makes it possible to apply an appropriate amount of the film-forming solution to an appropriate position, to reduce the amount of film-forming solution used, and to lower costs of manufacturing a liquid crystal display device, for example.

The present invention provides a film-forming method of forming a film on a substrate, including a surface-improving treatment step for performing a surface-improving treatment on the substrate, a determination step for determining whether a predetermined amount of time has passed since the surface-improving treatment has been performed on the substrate in the surface-improving treatment step, and a film-forming solution application step for applying a film-forming solution to the substrate when it is determined in the determination step that the predetermined amount of time has not passed.

Also, in the film-forming method according to still another aspect of the present invention, the surface-improving treatment step includes a step in which the substrate is subjected to lyophilic treatment.

In this film-forming method, it is determined whether a predetermined amount of time has passed since the surface-improving treatment has been conducted, and the substrate is conveyed to the film-forming solution applicator and coated with a film-forming solution when the specific amount of time has not passed. Therefore, a film with a substantially uniform thickness can be formed with high precision because the film-forming solution can be applied to the substrate within the predetermined amount of time after the lyophilic treatment, that is, to a substrate having sufficient wettability.

Also, the film-forming method according to still another aspect of the present invention further includes a rejection step for preventing the substrate from being conveyed to a film-forming solution applicator when it is determined in the determination step that the predetermined amount of time has passed.

In this film-forming method, a substrate for which a specific amount of time has passed following the surface-improving treatment is prevented from being conveyed to the film-forming solution applicator. Therefore, a substrate that does not have sufficient wettability can be prevented from being coated with the film-forming solution, and a non-uniform film can be appropriately prevented from being formed.

Also, in the film-forming method according to still another aspect of the present invention, the film-forming solution is applied to the substrate in the film-forming solution applying step with an inkjet droplet ejection apparatus.

According to this film-forming method, an inkjet droplet ejection apparatus is used as the film-forming solution applicator. Specifically, the substrate must have the appropriate wettability when coated with a film-forming solution using an inkjet droplet ejection apparatus, and only a substrate having sufficient wettability is conveyed in this film-forming method. Therefore, a film with a substantially uniform thickness can be formed with high precision by using an inkjet droplet ejection apparatus, and it is possible to efficiently reduce the amount of film-forming solution used.

Also, the film-forming method according to still another aspect of the present invention further includes a first conveying step for conveying the substrate from a surface-improving treatment device to a film-forming solution applicator, and a second conveying step for conveying the substrate to the surface-improving treatment device after the substrate is prevented from being conveyed to the film-forming solution applicator in the rejection step.

Also, the film-forming method according to still another aspect of the present invention further includes a timer starting step for, before the first conveying step, starting a timer for the substrate that has been subjected to the surface-improving treatment in the surface-improving treatment step, and a time period determination step for, after the first conveying step, obtaining a time period since the time the timer is started in the timer starting step. In the determination step, the time period obtained in the time period determination step is compared with the predetermined amount of time.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 3 is a graph describing the allowable film-forming treatment time in the embodiment.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
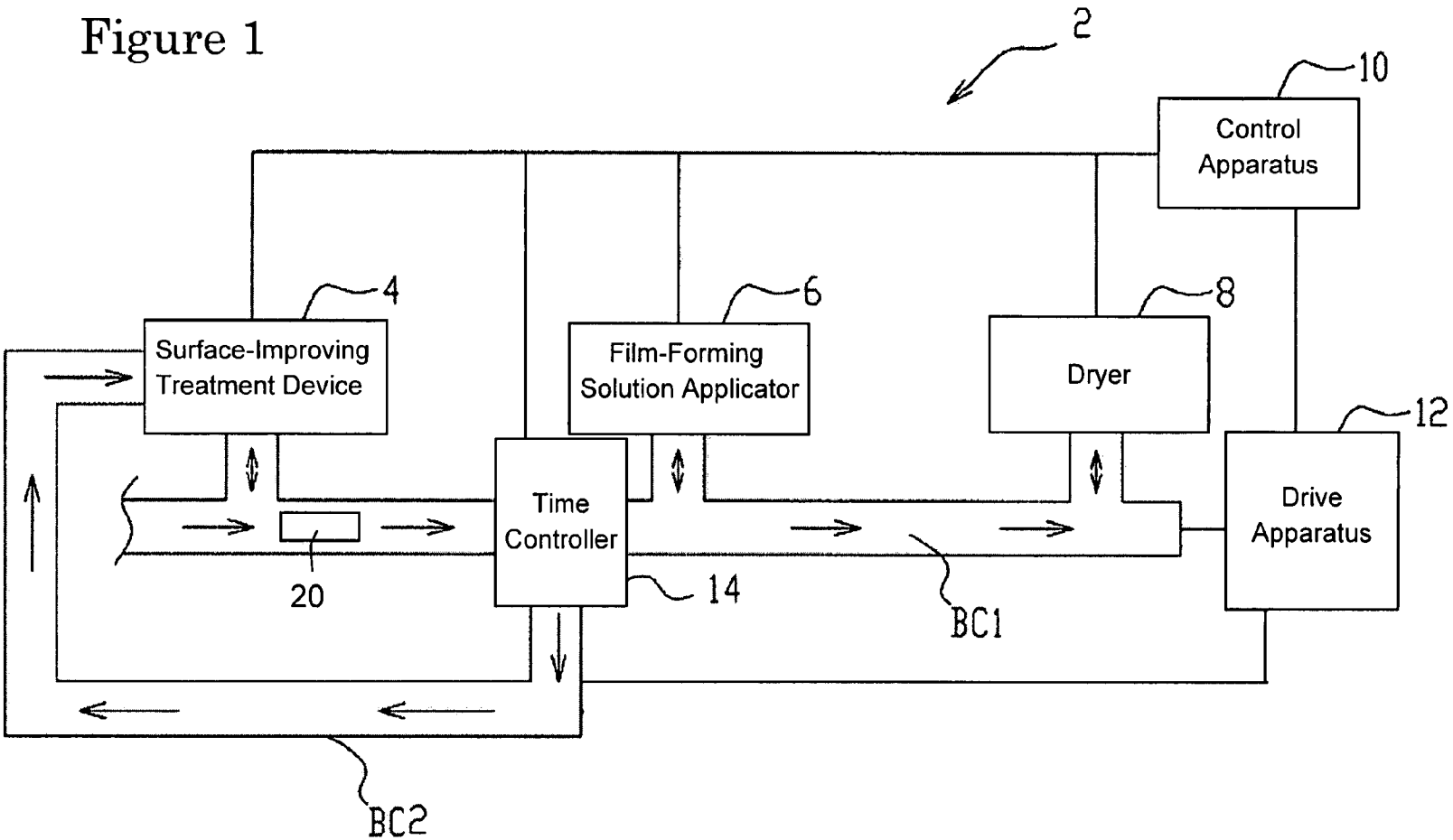
FIG. 1 is a schematic diagram showing the film-forming line in accordance with an embodiment.

The film-forming apparatus according to an embodiment of the present invention will now be described with reference to the appended figures. FIG. 1 is a diagram showing an example of the film-forming apparatus (film-forming line) according to the embodiment of the present invention.

As shown in FIG. 1, a film-forming line 2 is configured from a surface-improving treatment device 4, a film-forming solution applicator 6, a dryer 8, a belt conveyor BC1 connecting these devices, a time controller 14, a belt conveyor BC2 connecting the time controller 14 and the surface-improving treatment device 4, a drive apparatus 12 for driving the belt conveyor BC1 and the belt conveyor BC2, and a control apparatus 10 for controlling the entire film-forming line 2. Also, the surface-improving treatment device 4, the film-forming solution applicator 6, and the dryer 8 are disposed in alignment at specific intervals along the belt conveyor BC1, and the time controller 14 is disposed near the film-forming solution applicator 6 between the surface-improving treatment device 4 and the film-forming solution applicator 6.

The control apparatus 10 is operatively connected to the surface-improving treatment device 4, the film-forming solution applicator 6, the dryer 8, the drive apparatus 12, and the time controller 14. The control apparatus 10 includes a microcomputer with a control program to selectively send control signals and/or receive data from any of the devices connected thereto. The drive apparatus 12 drives the belt conveyor BC1 in response to a control signal from the control apparatus 10, and conveys the substrate to be treated to the surface-improving treatment device 4, the time controller 14, the film-forming solution applicator 6, and the dryer 8.

A surface-improving treatment such as a lyophilic treatment is performed in the surface-improving treatment device 4 for improving the wet expansion of the film-forming solution on the substrate surface. The surface-improving treatment device 4 may perform surface-improving treatments other than the lyophilic treatment. Since such surface-improving treatments are well known in the art, detailed explanations herein will be omitted.

The film-forming solution applicator 6 coats the substrate with a film-forming material (film-forming solution) for forming a predetermined film, and the dryer 8 dries the film-forming solution thus applied. An inkjet droplet ejection apparatus is used as the film-forming solution applicator 6 in the film-forming line 2.

The substrate conveyed from the surface-improving treatment device 4 by the belt conveyor BC1 is subjected to a process by the time controller 14 that determines whether a predetermined amount of time has passed since the surface-improving treatment has been conducted. When there is a substrate for which a predetermined amount of time has passed after the surface-improving treatment in the surface-improving treatment device 4, such substrate is conveyed back from the time controller 14 to the surface-improving treatment device 4 by the belt conveyor BC2, with the belt conveyor BC2 being driven by the drive apparatus 12 in response to a control signal from the control apparatus 10. When there is a substrate for which the predetermined amount of time has not passed after the surface-improving treatment, the belt conveyor BC1 is driven by the drive apparatus 12 in response a control signal from the control apparatus 10, and the substrate is conveyed from the time controller 14 to the film-forming solution applicator 6 by the belt conveyor BC1. In the film-forming line 2, the substrate subjected to the surface-improving treatment in the surface-improving treatment device 4 is stored in a cassette 20 that has a timer (not shown), and is conveyed to the time controller 14 by the belt conveyor BC1.

Figure 2:
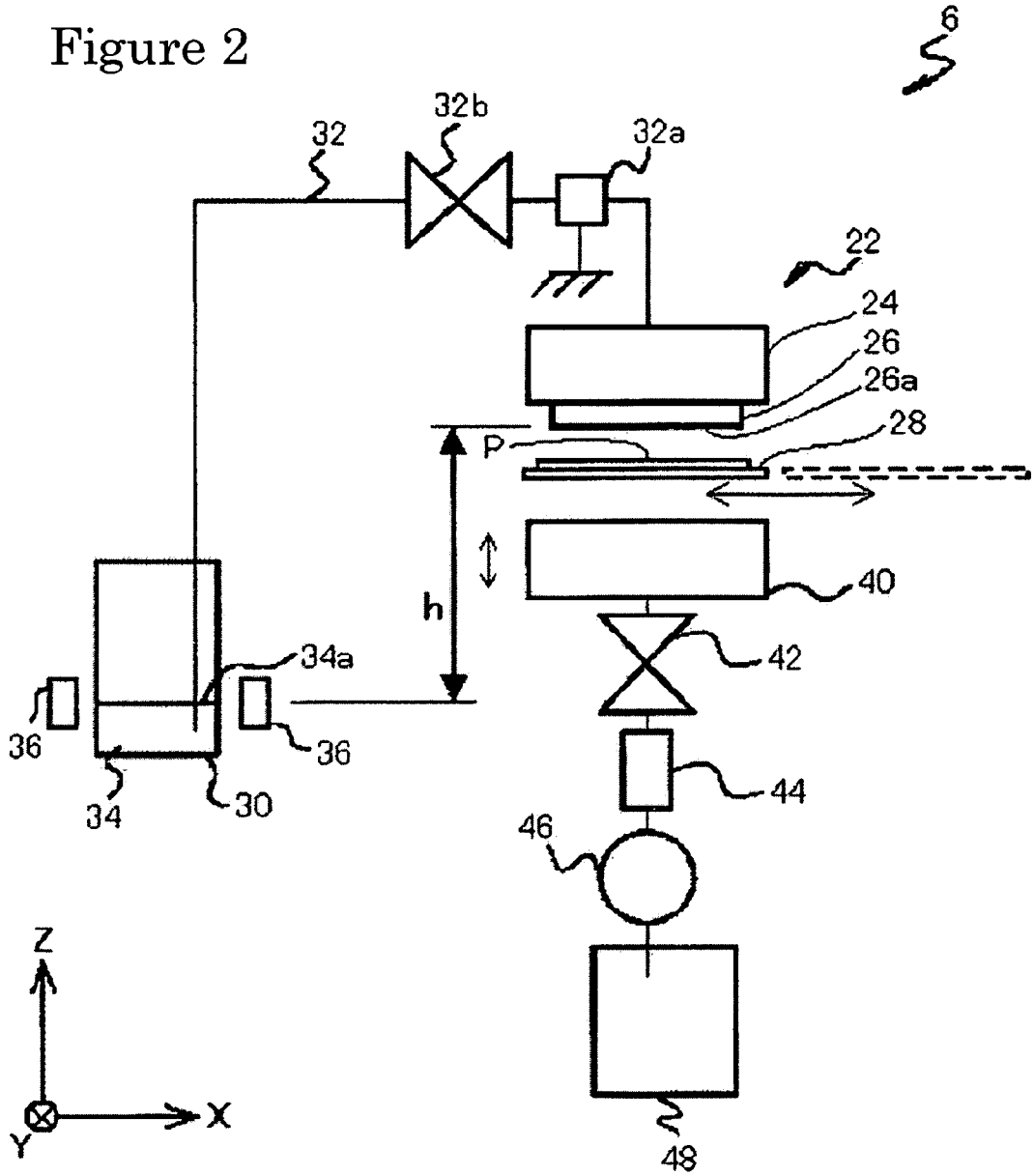
FIG. 2 is a schematic view of an inkjet droplet discharge apparatus according to the embodiment.

FIG. 2 is a schematic diagram showing an inkjet droplet ejection apparatus used as the film-forming solution applicator 6 according to the embodiment of the present invention. The film-forming solution applicator (droplet discharge apparatus) 6 includes an inkjet head 22 for discharging a discharge material onto a substrate P. This inkjet head 22 includes a head main body 24 and a nozzle surface 26 on which a plurality of nozzles from which the discharge material is to be discharged is formed. The discharge material, that is, the film-forming solution of the film-forming material in droplet form, is discharged from the nozzles of the nozzle surface 26. Also, the film-forming solution applicator 6 includes a table 28 on which the substrate P is to be mounted. The table 28 is configured to be capable of moving in predetermined directions; for example, the X-axis direction, the Y-axis direction, and the Z-axis direction. In this embodiment, the table 28 is moved in a direction along the X-axis as shown by the arrow in the FIG. 2, whereby the substrate P conveyed by the belt conveyor BC1 is mounted on the table 28 and is brought into the film-forming solution applicator (droplet discharge apparatus) 6.

A tank 30 for storing the film-forming solution, which is the material that is discharged from the nozzles formed in the nozzle surface 26, is connected to the inkjet head 22. Specifically, the tank 30 and the inkjet head 22 are connected by a discharge material conveying tube 32 for conveying the material to be discharged. Also, the discharge material conveying tube 32 includes a head bubble removal valve 32*b* and a discharge material channel grounding joint 32*a*, which preventing electrical charges within the discharge material conveying tube 32. This head bubble removal valve 32*b* is used when the discharge material in the inkjet head 22 is suctioned out by a suction cap 40. Specifically, when the discharge material in the inkjet head 22 is suctioned out by the suction cap 40, the head bubble removal valve 32*b* is closed to ensure that additional discharge material does not flow in from the tank 30. When suction is applied with the suction cap 40, the flow rate of the suctioned discharge material increases, and the air bubbles in the inkjet head 22 are expelled quickly as a result.

The film-forming solution applicator 6 also includes a liquid level control sensor 36 for controlling the amount of discharge material stored in the tank 30, in other words the liquid level 34*a* of the film-forming solution stored in the tank 30. The liquid level control sensor 36 controls the difference h in height between the distal end 26*a* of the nozzle surface 26 of the inkjet head 22 and the liquid level 34*a* in the tank 30, so that the difference is kept within a predetermined range. In this manner, the discharge material 34 in the tank 30 can be fed to the inkjet head 22 at a pressure that is within a predetermined range, by controlling the height of the liquid level 34*a*. The discharge material 34 is discharged from the inkjet head 22 in a stable manner by feeding the discharge material 34 at a pressure that is within a predetermined range.

The suction cap 40 for suctioning out the discharge material from the nozzles of the inkjet head 22 is disposed at a predetermined distance from the nozzle surface 26 of the inkjet head 22. This suction cap 40 is capable of moving along the Z axis shown by the arrow in FIG. 2, and being brought into close attachment with the nozzle surface 26 so as to enclose the plurality of nozzles formed on the nozzle surface 26, such that a hermetic space is formed between the cap 40 and the nozzle surface 26 and that the nozzles can be blocked off from the outside air. This suctioning out of the discharge material from the nozzles of the inkjet head 22 is carried out by the suction cap 40 when the inkjet head 22 is not discharging the discharge material 34; for example, when the inkjet head 22 retracts to a retracted position and the table 28 retracts to the position shown by the dashed line.

A channel is provided below the suction cap 40. A suction valve 42, a suction pressure detection sensor 44 for detecting suction abnormalities, and a suction pump 46 made from a tube pump or the like are disposed in the channel. The discharge material 34 that is suctioned out by the suction pump 46 and is conveyed through the channel is stored in a waste liquid tank 48.

Figure 4:
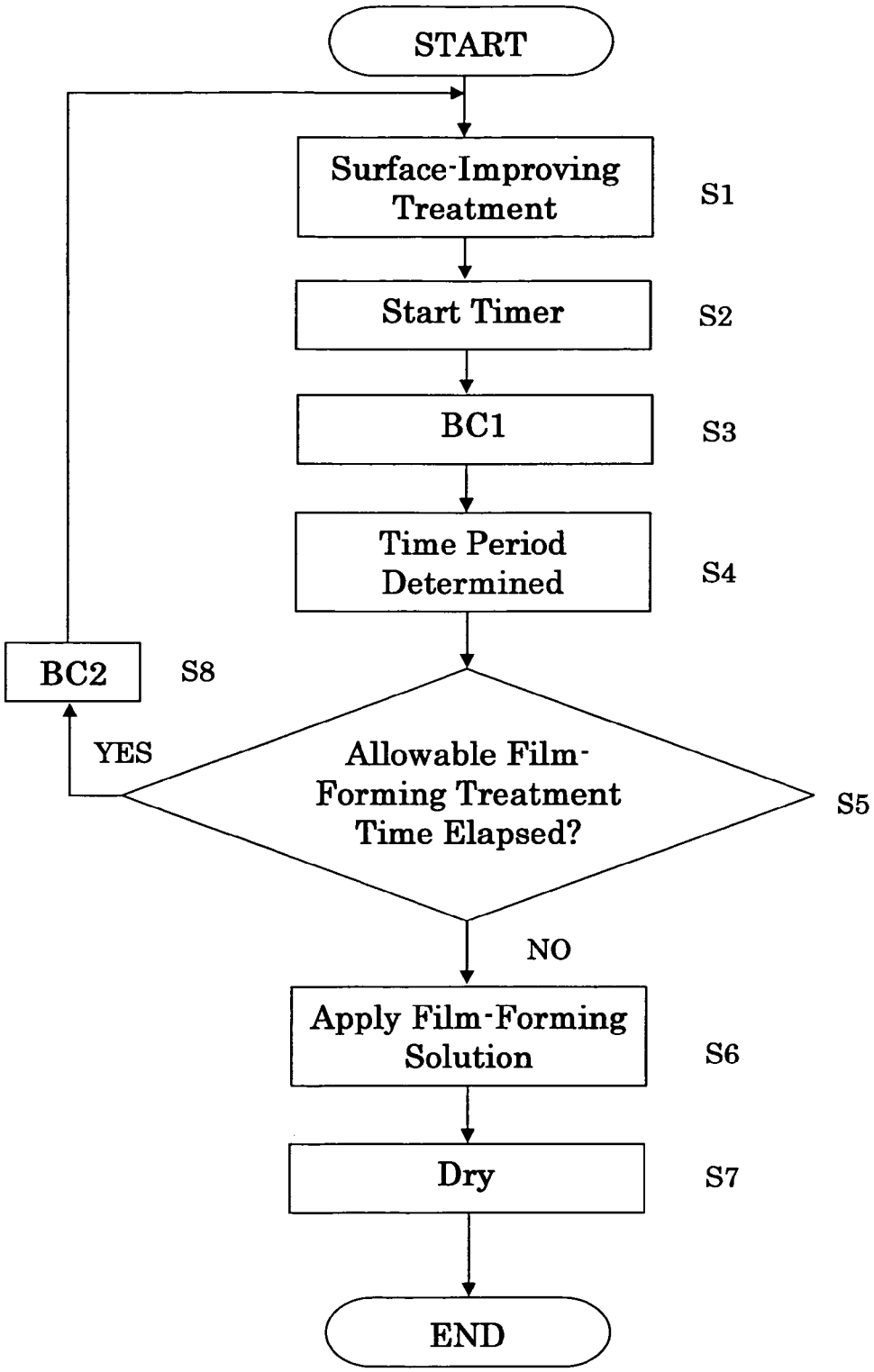
FIG. 4 is a flow chart of the film-forming steps in accordance with the embodiment.

The treatments performed on the substrate P in the film-forming line 2 will now be described with reference to the flow chart in FIG. 4. First, a surface-improving treatment is conducted on the substrate P in the surface-improving treatment device 4 (step S1). Specifically, the substrate P conveyed by the belt conveyor BC1 is brought into the surface-improving treatment device 4, and is subjected to a treatment such as a lyophilic treatment that improves the wet expansions of the film-forming solution on the surface of the substrate P. If, for example, a corona generator is used as the surface-improving treatment device 4, the substrate P is subjected to an atmospheric-pressure plasma treatment (lyophilic treatment) as the substrate P passes through the corona generator in which corona discharge takes place. Also, the wettability of the substrate P may be improved by using an apparatus that creates ozone with ultraviolet rays (UV) as the surface-improving treatment device 4, and conducting a UV ozone treatment. The corona generator, plasma treatment, and UV ozone treatment are known technologies in the art. Therefore, detailed explanations thereof will be omitted herein.

The substrate P that has undergone a surface-improving treatment in the surface-improving treatment device 4 is stored in a cassette 20 that has a timer, and is conveyed to the time controller 14 by the belt conveyor BC1 (step S3). The timer of the cassette 20 is started at the same time the substrate P is stored in the cassette 20 (step S2). As discussed above, the wettability of the substrate P that has been subjected to the surface-improving treatment such as an atmospheric-pressure plasma treatment or other lyophilic treatment decreases over time. Therefore, after the surface-improving treatment is conducted in the surface-improving treatment device 4, the substrate subjected to the surface-improving treatment must be conveyed to the film-forming solution applicator 6 while sufficient wettability is maintained on the surface of the substrate to apply the film-forming solution and form a coating film. The timer installed in the cassette 20 measures the time that has elapsed since the surface-improving treatment has been conducted. If a plurality of substrates, for example five substrates, are stored in one cassette 20, the timer is started the moment the first substrate is stored, and the time period measured by the timer is the same for all of the five substrates in the cassette 20.

FIG. 3 is a diagram showing the change in the contact angle over time in the substrate subjected to atmospheric-pressure plasma treatment. FIG. 3 shows the value of the contact angle at different elapsed times (in minutes) after the surface improving treatment is conducted, which shows a change in the wettability of the substrate P after the substrate P is subjected to the atmospheric-pressure plasma treatment. FIG. 3 also shows whether streaking has occurred at each contact angle of the substrate. A change in the wettability of the surface is indicated by the value of the contact angle; the smaller the contact angle is, the greater the wettability is. Also, the occurrence of streaking at a certain contact angle of the substrate indicates whether the film-forming solution can be uniformly applied. Specifically, as shown in FIG. 3, the symbol "○" in the streaking column indicates uniform wet expansion in the applied film-forming solution, and the symbol "Δ" indicates the presence of portions where the wet expansion of the film-forming solution is non-uniform. The symbol "x" in the streaking column indicates that the wet expansion of the applied film-forming solution is non-uniform. The occurrence of streaking for each contact angle is confirmed by conducting experimentations in advance with the film-forming line 2.

It is clear in FIG. 3 that wettability sufficient to form a film is maintained if less than 30 minutes have passed since the atmospheric-pressure plasma treatment was conducted as the surface-improving treatment. Therefore, "30 minutes" is stored as the allowable film-forming treatment time criterion in the time controller 14 in advance. If the substrate is conveyed to the film-forming solution applicator 6 within 30 minutes after the surface-improving treatment device 4 conducts the surface-improving treatment, a film-forming solution can be coated on the substrate that has sufficient wettability. Therefore, 30 minutes is the time within which sufficient wettability to apply the film-forming solution can be maintained, and is set in the time controller 14 as the period within which a film-forming treatment should be performed.

The allowable film-forming treatment time of 30 minutes shown in FIG. 3 pertains to the change in wettability for a case in which the atmospheric-pressure plasma treatment is conducted as the surface-improving treatment. However, if another treatment is conducted as the surface-improving treatment, then the allowable film-forming treatment time corresponding to this treatment may differ. For example, if UV ozone treatment is conducted as the surface-improving treatment, it is known that the contact angle increases and the occurrence of streaking becomes more likely within one minute after the treatment. Therefore, when UV ozone treatment is conducted, a time of 45 seconds, for example, is set as the allowable film-forming treatment time.

Next, in the time controller 14, a process is performed to obtain the time period data from the timer (step S4) and determine whether the allowable film-forming treatment time has elapsed (step S5) based on the time period data from the timer installed in the cassette 20 that stores the substrate P subjected to the surface-improving treatment. For example, the time controller 14 receives the time shown by the timer and determines whether this received time exceeds the allowable film-forming treatment time stored in the time controller 14. When 30 minutes is set as the allowable film-forming treatment time, for example, it is determined that the allowable film-forming treatment time has not been exceeded if the timer indicates a time period of shorter than 30 minutes. If the timer indicates a time period of 30 minutes or longer, it is determined that the allowable film-forming treatment time has been exceeded.

When the time controller 14 determines that the allowable film-forming treatment time has elapsed for a substrate P, the time controller 14 sends a signal to the control apparatus 10 indicating the determination result. The control apparatus 10 then sends a control signal to the drive apparatus 12, which then drives the belt conveyor BC2 in response to the control signal from the control apparatus 10. Then, the cassette 20 storing the substrate P is conveyed back from the time controller 14 to the surface-improving treatment device 4 by the belt conveyor BC2 (step S8). The surface-improving treatment device 4 takes in the substrate P conveyed by the belt conveyor BC2. The substrate P is subjected to the surface-improving treatment again. The substrate P thus treated is then stored in the cassette 20 having the timer, and transferred to the belt conveyor BC1.

Although it is the time controller 14 that determines whether the allowable film-forming treatment time has elapsed in the description above, the film-forming line of the present invention can also be configured such that the control apparatus 10 makes the determination. In this case, when a cassette 20 with a substrate stored therein reaches the time controller 14, the time controller 14 stops the timer on the cassette 20, and reads out the time period data from the timer. The time controller 14 then sends the time period data to the control apparatus 10, which then compares the time period data with the allowable film-forming treatment time criterion stored therein and determines whether the measured time period is longer than the allowable film-forming treatment time. If the time period obtained by the time controller 14 is longer than the allowable film-forming treatment time, the control apparatus 10 sends a control signal to the drive apparatus 12, which then drives the belt conveyor BC2 to convey the cassette 20 with the substrate stored therein back to the surface improving treatment device 4.

When the time indicated by the time controller 14 is shorter than the allowable film-forming treatment time, the cassette 20 having the timer with the substrate P stored therein is conveyed from the time controller 14 to the film-forming solution applicator 6 further by the belt conveyor BC1. Alternatively, the substrate P may be taken out of the cassette 20 in the time controller 14 before being conveyed to the film-forming solution applicator 6 by the belt conveyor BC1. Hereinbelow, an example is described in which only the substrate P is conveyed from the time controller 14 to the film-forming solution applicator 6 by the belt conveyor BC1.

In the film-forming solution applicator 6, a film forming solution, such as an orientation film ink for forming an orientation film in a liquid crystal display device, is applied to the substrate P (step S6). Specifically, the substrate P conveyed to the film-forming solution applicator 6 by the belt conveyor BC1 is mounted on the table 28 and brought into the film-forming solution applicator 6. In the film-forming solution applicator 6, the film-forming solution, such as a film-forming solution for forming an orientation film (orientation film ink), is stored in the tank 30 and discharged onto the surface of the substrate P from nozzles formed in the nozzle surface 26. In this manner, the substrate P is coated with the ink for orientation films. A solid polyimide dissolved in γ-butyl lactone or another such solvent, for example, can be used as the ink for orientation films. The substrate P coated with the ink for orientation films is then conveyed to the dryer 8 by the belt conveyor BC1.

Next, in the dryer 8, a treatment for drying the film-forming solution applied to the surface of the substrate P is conducted (step S7). Vacuum drying is performed as the drying treatment by using a vacuum dryer as the dryer 8, for example. Also, any other drying apparatus, such as the one that dries the film-forming solution with hot air, can be used as the dryer 8, as may be suitable for the type of film being formed. When, for example, an orientation film is being formed, baking is further performed in a baking apparatus (not shown in Figures) after the drying treatment is performed by the dryer 8. Thereafter, a rubbing apparatus (not shown) further performs rubbing, that is, a treatment of scuffing with a cloth or the like, on the dried film.

With the film-forming apparatus according to the embodiment of the present invention, the time that has elapsed after the surface-improving treatment is conducted in the surface-improving treatment device is monitored. Specifically, it is possible to monitor, based on the conveying time, the change in the wettability over time on the substrate that has been subjected to, for example, a lyophilic treatment as the surface-improving treatment. Therefore, it is possible to ensure that the film-forming solution is applied while appropriate wettability is maintained. Therefore, a film having a substantially uniform thickness can be formed on the substrate with high precision.

With the film-forming apparatus according to the embodiment of the present invention, only a substrate that has been subjected to the surface improving treatment within a predetermined time period (allowable film-forming treatment time) is conveyed to the film-forming solution applicator. Therefore, when, for example, an accident occurs while the substrate is conveyed and the operation of the film-forming line is halted, a substrate for which a time period longer than the allowable film-forming treatment time has elapsed since it has been subjected to the surface improving treatment can be prevented from being conveyed to the film-forming solution applicator. Therefore, a film with a substantially uniform thickness can be formed on the substrate even when accidents or the like occur.

With the film-forming apparatus according to the embodiment of the present invention, only a substrate of which the allowable film-forming treatment time has not elapsed is conveyed to the film-forming solution applicator 6 to be coated with the solution for forming the film. As a result, the film-forming solution can be applied to a substrate having sufficient wettability to form a uniform film. Therefore, when, for example, a liquid crystal display device is to be created, an orientation film having a substantially uniform thickness can be formed on the substrate in a stable manner. Thus, occurrence of unsatisfactory displays can be reduced.

In the film-forming apparatus according to the embodiment described above, a substrate subjected to the surface-improving treatment is conveyed to the film-forming solution applicator within the allowable film-forming treatment time. However, the present invention is not limited to such construction. It is also possible to allow only a substrate for which a predetermined time has passed after the surface-improving treatment has been conducted to be conveyed to the film-forming solution applicator.

In particular, there are cases where the contact angle of the substrate becomes too small as a result of the surface-improving treatment. For example, when the contact angle is less than 1 degree, the substrate becomes too wet, and it is difficult to adjust the film thickness. It is particularly difficult to apply a specific amount of the film-forming solution to a specific location because the applied film-forming solution tends to expand too much. This results in problems with the film-forming solution spreading to the reverse side of the substrate, for example. Therefore, it is better to allow only a substrate for which a specific time has passed after the surface-improving treatment and which has a contact angle within a specific range to be conveyed to the film-forming solution applicator 6. In this manner, it is possible to ensure that the film thickness and the coated area can be reliably adjusted.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-341593. The entire disclosure of Japanese Patent Application No. 2004-341593 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A film-forming method of forming a film on a substrate, comprising:

determining an allowable film-forming treatment time depending on a type of a surface-improving treatment based on a contact angle between the substrate and a film-forming solution with respect to an elapsed time after the surface-improving treatment is performed on the substrate so that the contact angle is maintained to be equal to or smaller than a prescribed angle after the surface-improving treatment is performed on the substrate;

setting a predetermined amount of time corresponding to the allowable film-forming treatment time in a time controller;

performing the surface-improving treatment on the substrate by a surface-improving treatment device;

conveying the substrate from the surface-improving treatment device to the time controller after the performing of the surface-improving treatment;

determining in the time controller whether the predetermined amount of time has passed since the surface-improving treatment has been performed on the substrate; and one of conveying the substrate from the time controller to a film-forming solution applicator and applying the film-forming solution to the substrate by the film-forming solution applicator whenever it is determined in the time controller that the predetermined amount of time has not passed, and conveying the substrate from the time controller to the surface-improving treatment device and repeating the surface-improving treatment on the substrate whenever it is determined in the time controller that the predetermined amount of time has passed.

2. The film-forming method according to claim 1, wherein each of the performing of the surface-improving treatment and the repeating of the surface-improving treatment includes a step in which the substrate is subjected to lyophilic treatment.

3. The film-forming method according to claim 1, further comprising preventing the substrate from being conveyed to the film-forming solution applicator when it is determined that the predetermined amount of time has passed.

4. The film-forming method according to claim 1, wherein the applying of the film-forming solution to the substrate includes applying the film-forming solution with an ink-jet droplet ejection apparatus.

5. The film-forming method according to claim 1, further comprising:

starting a timer for the substrate after the surface-improving treatment is performed on the substrate; and obtaining a time period since the time the timer is started in the time controller, wherein the determining of whether the predetermined amount of time has passed includes comparing the time period since the time the timer is started with the predetermined amount of time.

* * * * *